US006780070B2

(12) United States Patent
Ishikawa et al.

(10) Patent No.: US 6,780,070 B2
(45) Date of Patent: Aug. 24, 2004

(54) CONNECTOR

(75) Inventors: Ryotaro Ishikawa, Yokkaichi (JP); Hajime Kawase, Yokkaichi (JP); Hideto Nakamura, Yokkaichi (JP); Takeshi Tsuji, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/356,945

(22) Filed: Jan. 31, 2003

(65) Prior Publication Data

US 2003/0148669 A1 Aug. 7, 2003

(30) Foreign Application Priority Data

Feb. 1, 2002 (JP) ..... 2002-025227

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | | |
|---|---|---|---|---|
| 5,098,315 A | | 3/1992 | Scowen | |
| 5,209,676 A | | 5/1993 | Endo et al. | |
| 5,326,287 A | | 7/1994 | Hamakita et al. | |
| 5,378,176 A | | 1/1995 | Sasai | |
| 5,437,565 A | | 8/1995 | Atsumi et al. | |
| 5,464,356 A | | 11/1995 | Nebeshima et al. | |
| 5,643,015 A | | 7/1997 | Wakata | |
| 5,647,777 A | * | 7/1997 | Sasai et al. | 439/752 |
| 5,651,703 A | | 7/1997 | Sasai | |
| 5,674,096 A | | 10/1997 | Duclos et al. | |
| 5,928,034 A | | 7/1999 | Tabata et al. | |
| 5,980,333 A | * | 11/1999 | Nakamura et al. | 439/752 |
| 6,053,753 A | | 4/2000 | Kunkle | |
| 6,080,023 A | | 6/2000 | Meulemeester et al. | |
| 6,280,234 B1 | | 8/2001 | Yamamoto et al. | |
| 6,280,262 B1 | * | 8/2001 | Tanaka | 439/752 |
| 6,461,203 B2 | * | 10/2002 | Todo | 439/752 |
| 6,497,591 B2 | * | 12/2002 | Fujita | 439/752 |

* cited by examiner

*Primary Examiner*—Gary F. Paumen
(74) *Attorney, Agent, or Firm*—Anthony J. Casella; Gerald E. Hespos

(57) ABSTRACT

A connector has a housing (20) formed with cavities (21) for receiving terminal fittings (10). A retainer insertion hole (27) is formed in the bottom surface of the housing (20) over the entire width, and a retainer (40) provided with fasteners (44) is insertable into the retainer insertion hole (27). Locking pieces (45) at the opposite ends of the retainer (40) engage in insertion grooves (29) formed in side surfaces of the housing (20). The insertion grooves (29) cut the outer side surfaces of the cavities (21) at the opposite ends, and the locking pieces (45) serve as side walls of the cavities (21) when the retainer (40) is mounted.

12 Claims, 9 Drawing Sheets

CONNECTOR

BACKGROUND OF THE INVENTION

1. Field of the Invention

The invention relates to a connector with a retainer.

2. Description of the Related Art

U.S. Pat. No. 5,437,565 and FIG. 10 herein disclose a connector with a side-type retainer. With reference to FIG. 10, the connector includes terminal fittings 1 mounted in cavities 2 of a housing 3. A long narrow retainer insertion hole 4 extends into the bottom surface of the housing 3 transverse to the cavities 2. The terminal fittings 1 are locked in the cavities 2 by fasteners 4 of a retainer 6 that is inserted into the retainer insertion hole 4. Locking pieces 7 at opposite ends of the retainer 6 are inserted into insertion grooves at the opposite sides of the retainer insertion hole 4 and engage a locking section as the retainer 6 is inserted. Thus, the retainer 6 is held in the housing 3.

A disengaging jig can be inserted through an opening of the retainer insertion hole 4 to catch an operable portion 8 of the retainer 6 and to disengage the locking pieces 7 from the locking sections while twistingly withdrawing the retainer 6. Several cavities 2 are arranged side by side to make the connector laterally long, a position where the retainer 6 is withdrawn by the disengaging jig is spaced significantly from locking positions of the locking pieces 7. Consequently, it is more difficult to disengage the locking pieces 7. The present invention was developed in view of the above problem and an object thereof is to facilitate a detaching operation of a retainer.

SUMMARY OF THE INVENTION

The invention relates to a connector with a housing that has cavities for receiving terminal fittings. The housing also has a retainer insertion hole for receiving a retainer that has fasteners for locking the respective terminal fittings. Resiliently deformable locking pieces are provided at the opposite ends of the retainer, and insertion grooves are formed in side surfaces of the housing for receiving the locking pieces. Locking sections are provided at the bottoms of the insertion grooves for engaging the corresponding locking pieces. The bottoms of the insertion grooves cut side surfaces of the cavities, and the locking pieces serve as side walls of the cavities when the retainer is mounted.

The retainer is locked by the locking pieces inserted into the insertion grooves in the side surfaces of the housing. Thus, the retainer can be detached and freed from its locked state by directly resiliently deforming the locking pieces. Thus, an operation of detaching the retainer is facilitated.

The insertion grooves are formed in the side surfaces of the cavities and the locking pieces serve also as the side walls of the cavities. Thus, the housing is narrower.

Each insertion groove preferably has a protecting wall for covering a part of the insertion groove near the locking section from outside. Thus, the locking pieces will not be struck by another member and inadvertently disengaged from the locked state.

Each protecting wall preferably has a jig insertion opening through which a disengaging jig can be inserted. The disengaging jig can be inserted through the jig insertion opening in the protecting wall to catch and deform the corresponding locking piece, thereby disengaging the locking piece.

The jig insertion opening preferably is formed by cutting away a portion of the protection wall.

The ends of the locking pieces and the ends of the insertion grooves preferably are engaged with each other by a dovetail engaging construction. Thus, the locking pieces cannot warp away from one another.

The retainer preferably is partly mountable at a position where the fasteners are retracted from the cavities to permit the insertion and withdrawal of the terminal fittings into and from the cavities. Thus, operability can be improved.

The retainer preferably can be held at the position where the fasteners are retracted from the cavities by engaging the locking pieces with locking portions on the housing.

The terminal fittings preferably are locked in the cavities by locks in the cavities. Each lock preferably engages the terminal fitting in a position spaced along the inserting direction of the terminal fitting from the position where the retainer engages the terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 5:
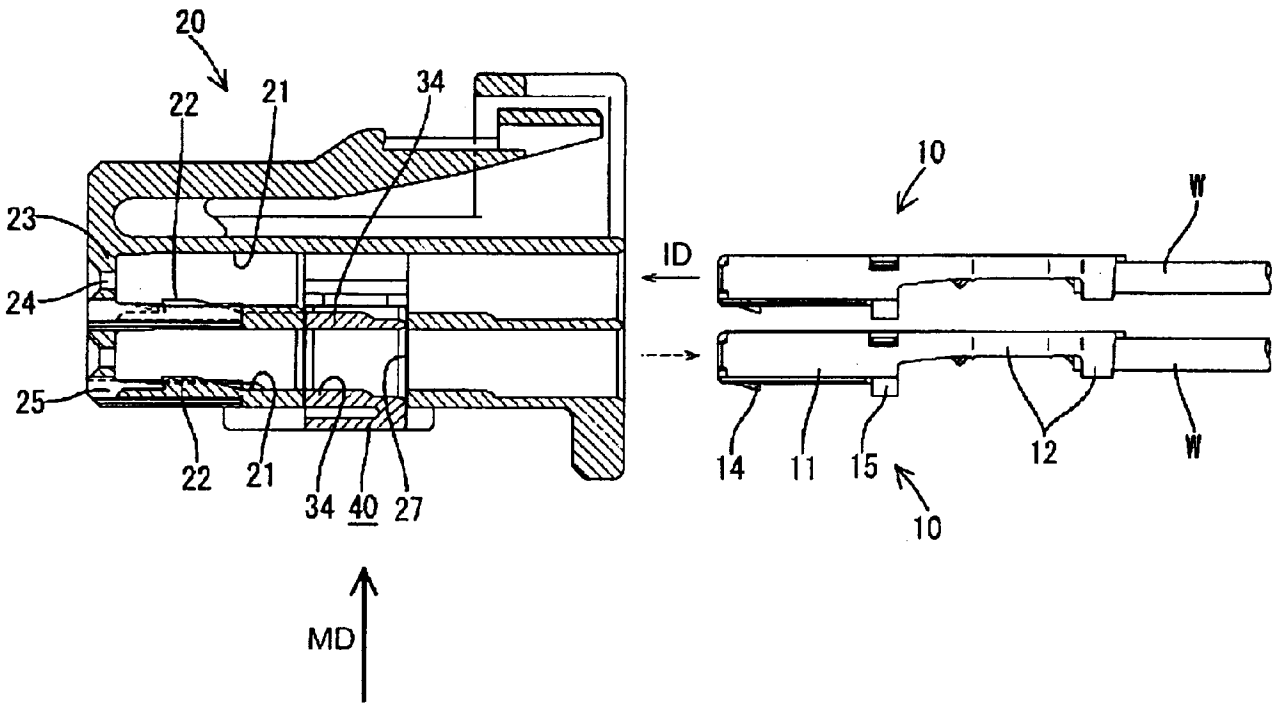
FIG. 5 is a longitudinal side view in section of the connector showing the insertion and withdrawal of female terminal fittings.

A female connector according to the invention includes female terminal fittings 10, as shown in FIG. 5. Each female terminal fitting 10 has opposite front and rear ends. A substantially rectangular tubular connecting portion 11 is formed at the front end and is configured for connection with a tab of a mating male terminal fitting. Crimping barrels 12 are formed at the rear end of the female terminal fitting 10 and are configured for connection with an end of a wire W. First and second engageable portions 14 and 15 project from the bottom of the connecting portion 11. The first engageable portion 14 is slightly behind the front end of the female terminal fitting 10 and the second engageable portion 15 is at a more backward position.

Figure 1:
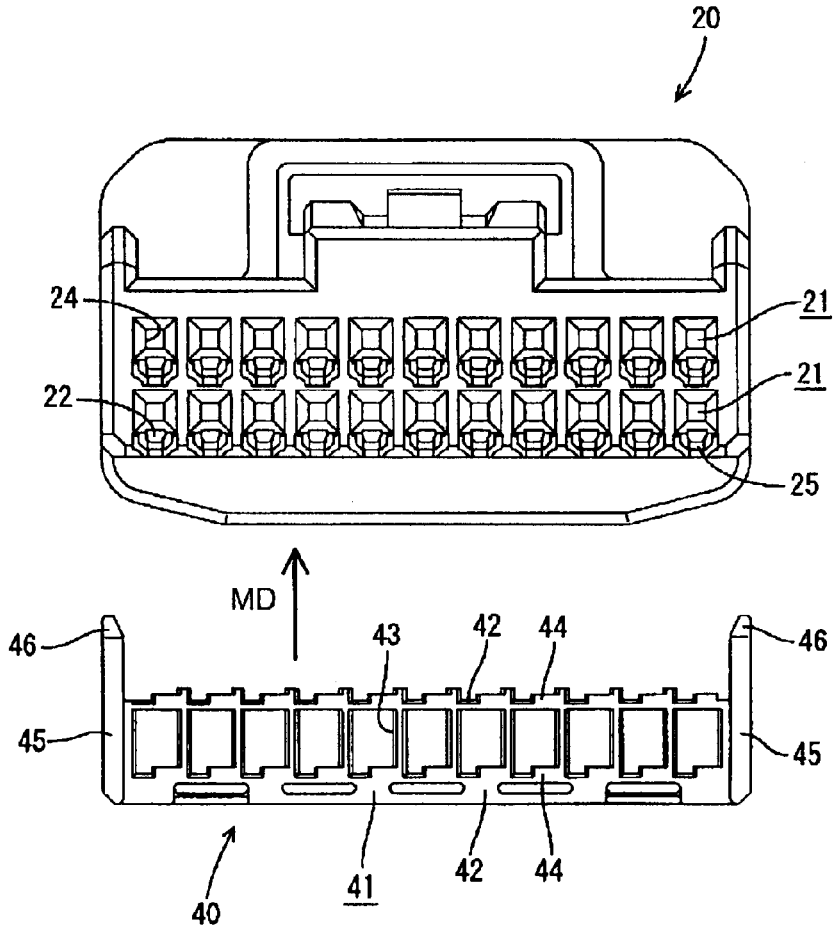
FIG. 1 is a front view of a connector according to one embodiment of the present invention before a retainer is mounted.
Figure 2:
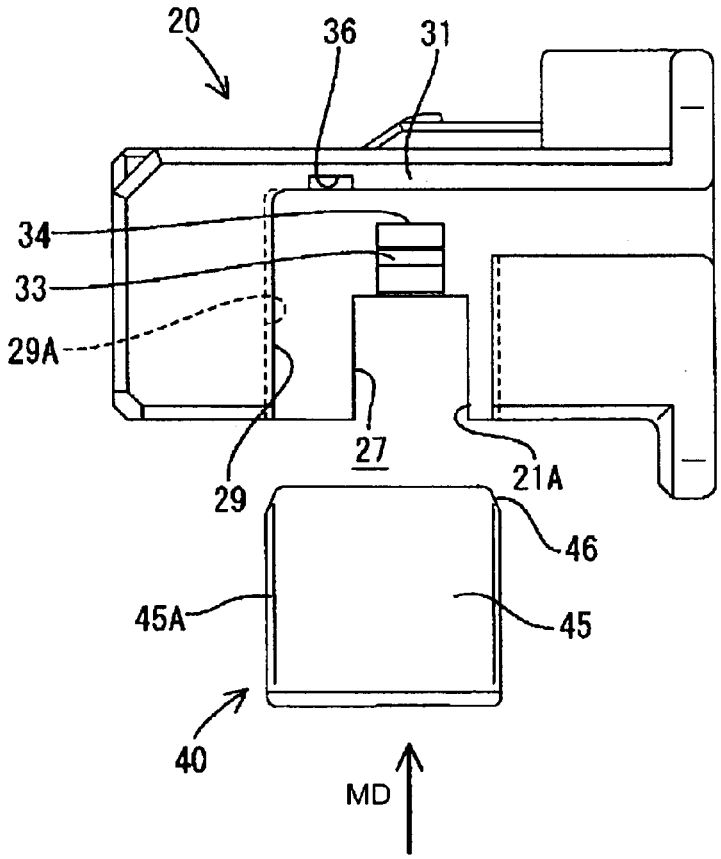
FIG. 2 is a side view of the connector.
Figure 3:
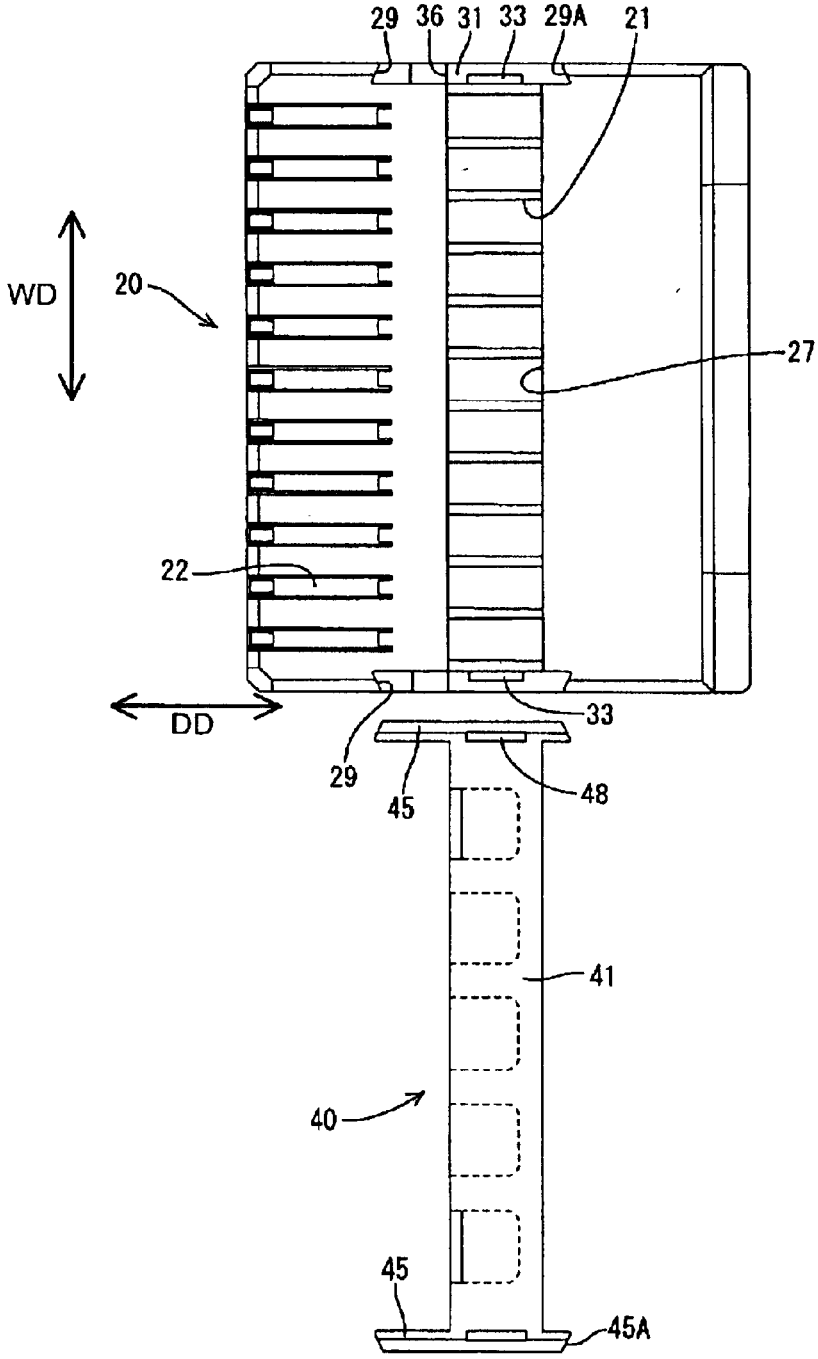
FIG. 3 is a bottom view of the connector.

The connector also includes a slightly wide block-shaped housing 20 formed e.g. of a synthetic resin, as shown in FIGS. 1 to 3. Cavities 21 extend forward and backward through the housing 20, as shown in FIG. 5, and are arranged in upper and lower stages. Each cavitiy 21 is configured to accommodate one of the female terminal fittings 10 that is inserted from behind along an insertion direction ID. A lock 22 is provided on the bottom surface of each cavity 21 near the front end, and is engageable with the first engageable portion 14 of the female terminal fitting 10. The lock 22 is supported at both ends and is resiliently deformable away from an insertion path of the terminal fittings 10 into the cavities 21.

A terminal insertion opening 24 is formed in a front wall 23 of each cavity 21 and is configured to receive the tab of the mating male terminal fitting. A jig insertion opening 25 is formed below the terminal insertion hole 24 and is configured to receive a disengaging jig for resiliently deforming the lock 22.

Figure 6:
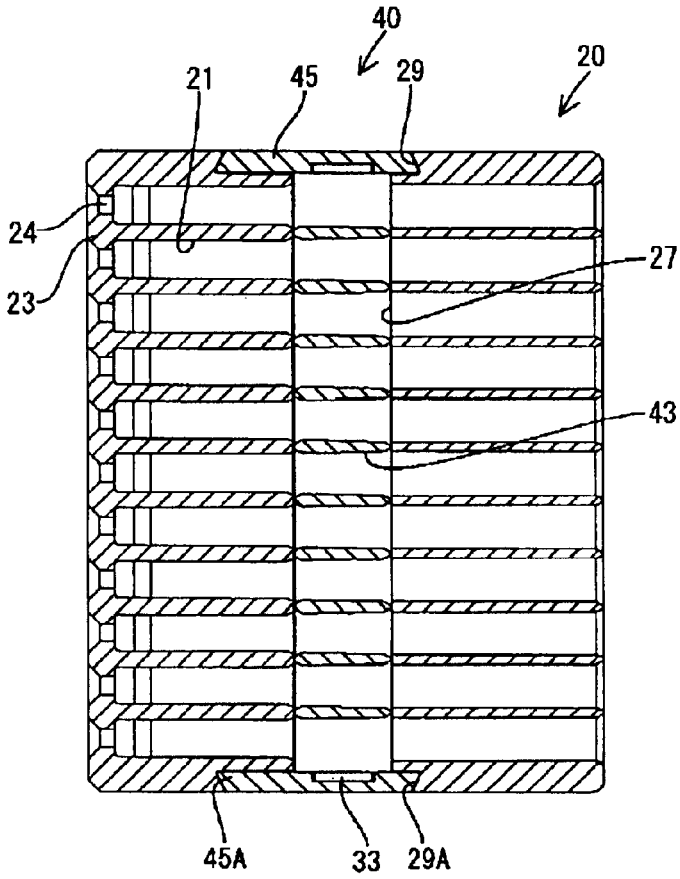
FIG. 6 is a section of the connector viewed from below showing a state where the retainer is held at a partial locking position.

A retainer insertion hole 27 is formed in the bottom surface of the housing 20 over substantially the entire width (see FIG. 6). The retainer insertion hole 27 vertically penetrates the cavities 21 along a moving direction MD that is substantially normal to the insertion direction ID of the terminal fittings 10.

The connector further includes a retainer 40 formed e.g. of a synthetic resin and configured for insertion into the retainer insertion hole 27. The retainer 40 has a base 41 for fitting closely into the retainer insertion hole 27 and locking pieces 45 that stand up at left and right ends of the base 41. The base 41 of the retainer 40 further has shelves 42 at upper and lower stages, as shown in FIG. 1. Window holes 43 are formed between the adjacent shelves 42 and correspond to the respective cavities 21. Fasteners 44 are arranged on the upper surfaces of the shelves 42 at the same intervals as the cavities 21 for engaging the second engageable portions 15 of the female terminal fittings 10.

The left and right locking pieces 45 have a larger dimension than the base 41 with respect to the depth direction DD of the female housing 20, as shown in FIG. 3, and the upper sides of the locking pieces 45 are resiliently deformable away from each other and away from the housing 20.

Insertion grooves 29 are formed in the left and right side surfaces of the housing 20, and the locking pieces 45 can be received in the insertion grooves 29 to be substantially flush with the left and right side surfaces of the housing 20. As shown in FIG. 2, the insertion grooves 29 communicate with the left and right ends of the retainer insertion hole 27 and each insertion groove 29 extends from the bottom edge of the corresponding side surface of the housing 20 to a position slightly below the upper edge thereof. The bottoms of the insertion grooves 29 cut the outer walls of the cavities 21 at the left and right ends of the lower stage. Thus, the respective lateral cavities 21 are laterally open in the absence of the locking piece 45. Accordingly, the insertion grooves 29 and the respective lateral cavities 21 communicate with each other.

As shown in FIGS. 3 and 6, each insertion groove 29 is formed with dovetail sides 29A and gradually narrowed from its inner edge toward its opening edge. Similarly, the locking piece 45 has dovetail sides 45A and gradually narrows from the inner surface toward the outer surface. A dovetail engaging construction also is provided between the ends of the corresponding locking piece 45 and insertion groove 29. Additionally, both corners of the upper ends of the locking pieces 45 in the moving direction MD are chambered to form C-shaped guiding surfaces. Further, protection walls 31 are defined at the closed upper ends of the insertion grooves 29.

Figure 4:
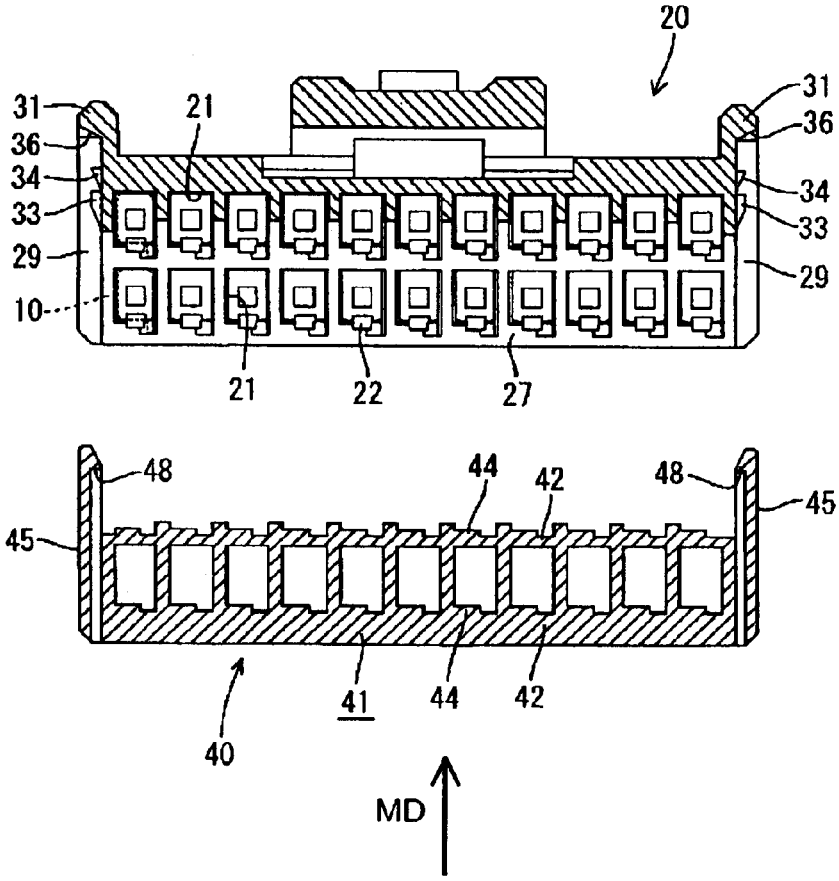
FIG. 4 is a lateral sectional view of the connector.

Hooks 48 are provided at the upper ends of the opposite surfaces of the locking pieces 45, as shown in FIG. 4, and are at positions corresponding to the base 41 with respect to depth direction DD, as shown in FIG. 3.

Partial and full locking projections 33 and 34 are provided on the bottom of each insertion groove 29 and are disposed one above the other right above an opening 21A that corresponds to the cavities 21, as shown in FIG. 2.

Figure 7:
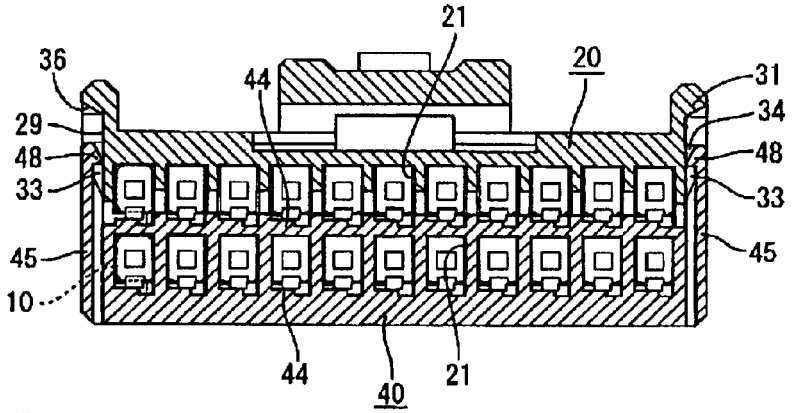
FIG. 7 is a lateral sectional view of the connector in the state of FIG. 7.
Figure 8:
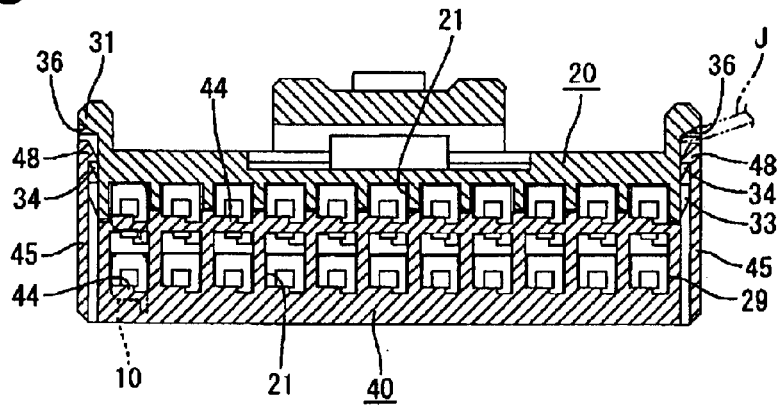
FIG. 8 is a lateral sectional view of the connector showing a state where the retainer is held at a full locking position.

The retainer 40 is inserted into the retainer insertion hole 27 in the moving direction MD while the locking pieces 45 are inserted into the insertion grooves 29. The retainer 40 is at a partial locking position when the hooks 48 of the locking pieces 45 engage the partial locking projections 33 at the lower side, as shown in FIG. 7. Each fastener 44 of the retainer 40 is retracted down from the corresponding cavity 21 in a direction opposite to the moving direction MD when the retainer 40 is at the partial locking position, thereby permitting insertion and withdrawal of the female terminal fitting 10 along the insertion direction ID into and from the cavity 21. On the other hand, the retainer 40 is at a full locking position when the hooks 48 engage the full locking projections 34, as shown in FIG. 8. Each fastener 44 projects into the corresponding cavity 21 from below or in the moving direction MD when the retainer 40 is at the full locking position.

Jig insertion openings 36 are formed by obliquely cutting the edges of the protecting walls 31 at positions before the locks 33, 34, as shown in FIGS. 2 and 4, and are configured for receiving a disengaging jig J (see FIG. 8). Thus, the jig insertion openings 36 are defined laterally between the protecting walls 31 and the front edge of the locking pieces 45 as seen in the moving direction MD.

The connector is assembled by inserting the retainer 40 along the moving direction MD to the partial locking position in the retainer insertion hole 27, as shown in FIGS. 5 and 7. Each female terminal fitting 10 then is inserted from behind along the inserting direction ID and into the corresponding cavity 21, as indicated by the solid-line arrow in FIG. 5. Insertion forces of the female terminal fitting 10 deform the lock 22. However, the lock 22 is restored resiliently when the female terminal fitting 10 reaches a proper position, and the restored lock 22 engages the first engageable portion 14 from behind, (see FIG. 9). Thus, the female terminal fittings 10 are locked partly so as not to come out in a withdrawing direction.

Figure 9:
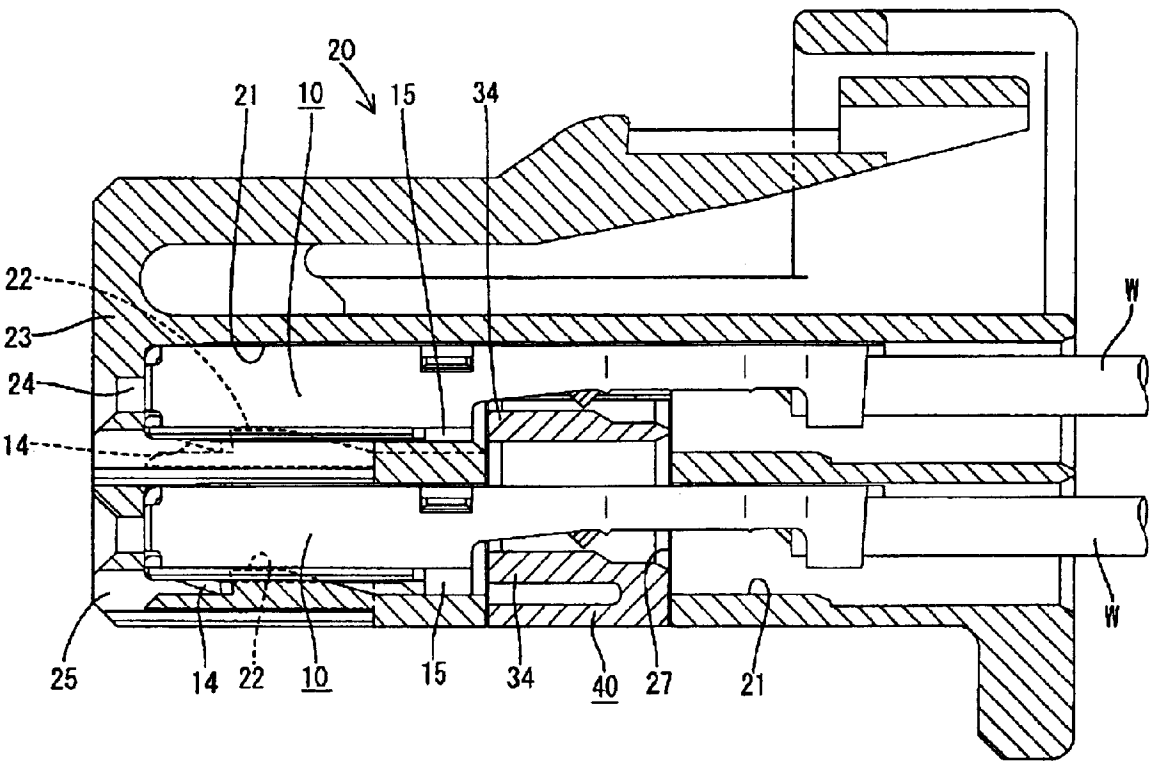
FIG. 9 is a longitudinal section of the connector in the state of FIG. 8.
Figure 10:
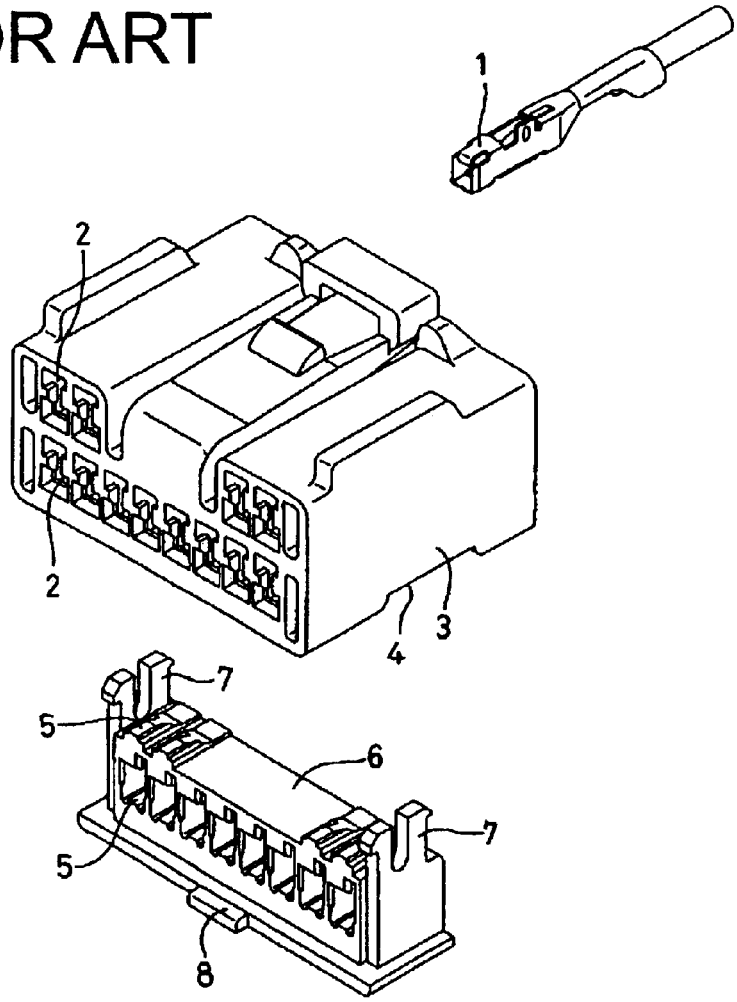
FIG. 10 PRIOR ART
FIG. 10 is an exploded perspective view of a prior art connector.

The retainer 40 is pushed further in the moving direction MD to the full locking position shown in FIGS. 8 and 9 after all the female terminal fittings 10 are inserted into the cavities 21. Thus, the fasteners 44 of the retainer 40 enter the corresponding cavities 21 and engage the second engageable portions 15 of the female terminal fittings 10 from behind. Accordingly, the female terminal fittings 10 are locked doubly and cannot come out. At this stage, as shown in FIG. 8, the leading ends of the locking pieces 45 are substantially covered by the protecting walls 31 along the moving direction MD, thereby preventing the leading ends of the locking pieces 45 from being disengaged inadvertently from the locking projections 34 due to contact by another member.

The female terminal fitting 10 may have to be withdrawn from the housing 20 for maintenance or other reason. Withdrawal is achieved by inserting the disengaging jig J through the jig insertion opening 36 to catch the upper end of the locking piece 45, as shown in FIG. 8. The disengaging jig J then is pivoted like a lever so that its leading end engages the engaging piece 45. Thus, the upper end of the locking piece 45 is deformed resiliently and moves away from the housing 20. Accordingly, the hook 48 is disengaged from the full locking projection 34, and the disengaged locking piece 45 is pulled slightly out of the insertion groove 29 to engage the hook 48 with the partial locking projection 33.

Similarly, the other locking piece 45 also is deformed resiliently by the disengaging jig J and is disengaged from the full locking projection 34. Thereafter, the locking piece 45 is pulled slightly out in a direction opposite to the moving direction MD and engages the partial locking projection 33. Thus, the retainer 40 is held at the partial locking position, as shown in FIG. 7.

The fasteners 44 of the retainer 40 are retracted from the cavities 21 when the retainer 40 is at the partial locking position, and hence the fasteners 44 are disengaged from the second engageable portions 15 of the female terminal fittings 10. Thus, another disengaging jig can be inserted through the jig insertion hole 25 in the front wall 23 of the cavity 21 to push the lock 22 down and away from the terminal fitting 10, and the female terminal fitting 10 is disengaged from the partial locking portion 14. The wire W then is pulled out, as indicated by a chain-line arrow in FIG. 5, to withdraw the female terminal fitting 10 from the cavity 21.

As described above, the retainer 40 is locked by the locking pieces 45 inserted into the insertion grooves 29 in the side surfaces of the housing 20. Thus, the retainer 40 easily can be moved from its locked state merely by using the disengaging jig J to deform the locking pieces 45. Therefore, the retainer 40 can be returned easily from the full locking position to the partial locking position.

The bottoms of the insertion grooves 29 cut the side surfaces of the cavities 21 and the locking pieces 45 also serve as the side walls of the cavities 21. Thus, the housing 20 can be narrower in the widthwise direction WD.

Leading ends of the locking pieces 45 are covered by the protecting walls 31 when the locking pieces 45 are at the full locking position. Thus, the locking pieces 45 will not be struck and inadvertently disengaged.

The ends of the locking pieces 45 and the ends of the insertion grooves 29 are engaged with each other by the dovetail engaging construction. Thus, the locking pieces 45 will not warp to widen the space therebetween.

The invention is not limited to the above described and illustrated embodiment. For example, the following embodiments are also embraced by the technical scope of the present invention. Beside the following embodiments, various changes can be made without departing from the invention.

The retainer may be directly mounted to and detached from the full locking position without providing the partial locking position.

The lock in each cavity may be supported at only one end.

The present invention also is applicable to a male connector accommodating male terminal fittings.

What is claimed is:

1. A connector, comprising:

a housing having a top wall, a bottom wall and opposed external side walls, the housing being formed with cavities for receiving terminal fittings and bring formed with a retainer insertion hole open at one of the too and bottom walls and both of the external side walls, the retainer insertion hole communicating with the cavities, insertion grooves being formed in opposite outer side surfaces of the opposed external side walls of the housing and bottom surfaces of the insertion grooves being formed with locking sections, each of said insertion grooves communicating with at least one of said cavities at locations where said retainer insertion hole is open at the external side walls; and a retainer mounted to the housing and movable between first and second positions on the housing, the retainer having a body insertable into the retainer insertion hole, the body having fasteners substantially spaced from the cavities when the retainer is in the first position and being insertable into the respective cavities when the retainer is in the second position, resiliently deformable locking pieces being provided at opposite ends of the retainer and being insertable into the insertion grooves and engageable with the corresponding locking sections, the locking pieces defining side walls that cover portions of the cavities that communicate with the insertion grooves both when the retainer is in the first position and the second position.

2. The connector of claim 1, wherein the retainer insertion hole is narrow and long along an arranging direction of the cavities.

3. A connector comprising:

a housing formed with cavities and with a retainer insertion hole communicating with the cavities, insertion grooves being formed in opposite outer side surfaces of the housing and bottom surfaces of the insertion grooves being formed with locking sections, each of said insertion grooves communicating with at least one of said cavities;

a retainer having a body insertable into the retainer insertion hole, the body having fasteners insertable into the respective cavities, resiliently deformable locking pieces being provided at opposite ends of the retainer and being insertable into the insertion grooves and engageable with the corresponding locking sections, the jacking pieces defining side walls for portions of the cavities that communicate with the insertion grooves;

each said insertion groove having a protecting wall for covering a part of the insertion groove near the locking section from outside along a moving direction of the retainer, and wherein each protecting wall is formed with a jig insertion opening for receiving a disengaging jig to deform and disengage the corresponding locking piece.

4. The connector of claim 3, wherein the jig insertion opening is formed by cutting away a portion of the protection wall.

5. The connector of claim 1, wherein ends of the locking pieces and ends of the insertion grooves are engaged by a dovetail engaging construction.

6. A connector, comprising:

a housing having a top wall, a bottom wall and opposed external side walls, the housing being formed with cavities for receiving terminal fittings and being formed with a retainer insertion hole oven at one of the too and bottom walls and both of the external side walls, the retainer insertion hole communicating with the cavities, insertion grooves being formed in opposite outer side surfaces of the opposed external side walls of the housing and bottom surfaces of the insertion grooves being formed with looking sections, each of said insertion grooves communicating with at least one of said cavities at locations where said retainer insertion hole is oven at the external side walls; and terminal fittings mounted respectively in the cavities; and a retainer mounted to the housing and movable between first and second positions on the housing, the retainer having a body insertable into the retainer insertion hole, the body having fasteners substantially spaced from the cavities when the retainer is in the first position so that the terminal fittings can be mounted in and removed from the cavities, the fasteners being insertable into the cavities when the retainer is in the second position for locking the respective terminal fittings in the cavities, resiliently deformable locking pieces being provided at opposite ends of the retainer and being insertable into the insertion grooves and engageable with the corresponding locking sections, the locking pieces defining side walls that cover portions of the cavities that communicate with the insertion grooves both when the retainer is in the first position and second position.

7. The connector of claim 6, wherein the housing is formed with locks projecting into the respective cavities, the locks being configured for locking the terminal fittings in the respective cavities.

8. The connector of claim 7, wherein each said lock engages the terminal fitting in a position spaced along an inserting direction of the terminal fitting from a position where the retainer engages the terminal fitting.

9. The connector of claim 6, wherein the retainer is mountable at the first position where the fasteners are retracted from the cavities by engaging the locking pieces with respective locking portions on the housing.

10. The connector of claim 6, wherein each insertion groove has a protecting wall for covering a part of the insertion groove near the locking section from outside along a moving direction of the retainer.

11. The connector of claim 10, wherein each protecting wall is formed with a jig insertion opening for receiving a disengaging jig to deform and disengage the corresponding locking piece.

12. The connector of claim 11, wherein the jig insertion opening is formed by cutting away a portion of the protection wall.

* * * * *